US008541951B1

(12) United States Patent
Shum et al.

(10) Patent No.: US 8,541,951 B1
(45) Date of Patent: Sep. 24, 2013

(54) HIGH TEMPERATURE LED SYSTEM USING AN AC POWER SOURCE

(75) Inventors: Frank Tin Chung Shum, Goleta, CA (US); Frank M. Steranka, Fremont, CA (US); Cliff Jue, Fremont, CA (US)

(73) Assignee: Soraa, Inc., Fremont, CA (US)

( * ) Notice: Subject to any disclaimer, the term of this patent is extended or adjusted under 35 U.S.C. 154(b) by 145 days.

(21) Appl. No.: 13/298,905

(22) Filed: Nov. 17, 2011

Related U.S. Application Data

(60) Provisional application No. 61/435,915, filed on Jan. 25, 2011, provisional application No. 61/414,821, filed on Nov. 17, 2010.

(51) Int. Cl.
*H05B 37/02* (2006.01)

(52) U.S. Cl.
USPC ..... 315/193; 315/297; 315/307

(58) Field of Classification Search
USPC ..... 315/185 R, 192, 193, 201, 291, 294, 315/297, 307
See application file for complete search history.

(56) References Cited

U.S. PATENT DOCUMENTS

| | | | | |
|---|---|---|---|---|
| 6,335,771 | B1 | 1/2002 | Hiraishi | |
| 6,498,355 | B1 | 12/2002 | Harrah et al. | |
| 6,621,211 | B1 | 9/2003 | Srivastava et al. | |
| 6,787,999 | B2 | 9/2004 | Stimac et al. | |
| 6,853,010 | B2 | 2/2005 | Slater, Jr. et al. | |
| 6,864,641 | B2 * | 3/2005 | Dygert | 315/216 |
| 6,956,246 | B1 | 10/2005 | Epler et al. | |
| 7,009,199 | B2 | 3/2006 | Hall | |
| 7,083,302 | B2 | 8/2006 | Chen et al. | |
| 7,113,658 | B2 | 9/2006 | Ide et al. | |
| 7,148,515 | B1 | 12/2006 | Huang et al. | |
| 7,252,408 | B2 | 8/2007 | Mazzochette et al. | |
| 7,253,446 | B2 | 8/2007 | Sakuma et al. | |
| 7,285,799 | B2 | 10/2007 | Kim et al. | |
| 7,550,305 | B2 | 6/2009 | Yamagata et al. | |
| 7,560,981 | B2 * | 7/2009 | Chao et al. | 327/540 |
| 7,658,528 | B2 | 2/2010 | Hoelen et al. | |
| 7,663,229 | B2 | 2/2010 | Lu et al. | |
| 7,737,457 | B2 | 6/2010 | Kolodin et al. | |
| 7,791,093 | B2 | 9/2010 | Basin et al. | |
| 7,824,075 | B2 | 11/2010 | Maxik | |
| 7,906,793 | B2 | 3/2011 | Negley | |
| 7,972,040 | B2 | 7/2011 | Li et al. | |
| 8,044,609 | B2 * | 10/2011 | Liu | 315/291 |
| 8,153,475 | B1 | 4/2012 | Shum et al. | |
| 8,203,161 | B2 | 6/2012 | Simonian et al. | |
| 8,207,554 | B2 | 6/2012 | Shum | |
| 8,269,245 | B1 | 9/2012 | Shum | |
| 8,404,071 | B2 * | 3/2013 | Cope et al. | 156/272.2 |
| 8,410,711 | B2 * | 4/2013 | Lin et al. | 315/224 |
| 2001/0022495 | A1 | 9/2001 | Salam | |
| 2004/0195598 | A1 | 10/2004 | Tysoe et al. | |
| 2004/0227149 | A1 | 11/2004 | Ibbetson et al. | |

(Continued)

OTHER PUBLICATIONS

USPTO Office Action for U.S. Appl. No. 12/880,889 dated Sep. 19, 2012.

(Continued)

*Primary Examiner* — Don Le
(74) *Attorney, Agent, or Firm* — Kilpatrick Townsend & Stockton LLP

(57) ABSTRACT

Power management and thermal management for high intensity LED lamps are disclosed.

20 Claims, 25 Drawing Sheets

(56) References Cited

U.S. PATENT DOCUMENTS

| | | | | |
|---|---|---|---|---|
| 2005/0084218 | A1 | 4/2005 | Ide et al. | |
| 2005/0199899 | A1 | 9/2005 | Lin et al. | |
| 2005/0224830 | A1 | 10/2005 | Blonder et al. | |
| 2006/0038542 | A1 | 2/2006 | Park et al. | |
| 2006/0065900 | A1 | 3/2006 | Hsieh et al. | |
| 2006/0068154 | A1 | 3/2006 | Parce et al. | |
| 2006/0097385 | A1 | 5/2006 | Negley | |
| 2006/0152795 | A1 | 7/2006 | Yang | |
| 2006/0205199 | A1 | 9/2006 | Baker et al. | |
| 2006/0208262 | A1 | 9/2006 | Sakuma et al. | |
| 2006/0240585 | A1 | 10/2006 | Epler et al. | |
| 2006/0262545 | A1 | 11/2006 | Piepgras et al. | |
| 2007/0018184 | A1 | 1/2007 | Beeson et al. | |
| 2007/0181895 | A1 | 8/2007 | Nagai | |
| 2008/0158887 | A1 | 7/2008 | Zhu et al. | |
| 2008/0194054 | A1 | 8/2008 | Lin et al. | |
| 2008/0210958 | A1 | 9/2008 | Senda et al. | |
| 2008/0261341 | A1 | 10/2008 | Zimmerman et al. | |
| 2009/0134421 | A1 | 5/2009 | Negley | |
| 2009/0173958 | A1 | 7/2009 | Chakraborty et al. | |
| 2009/0250686 | A1 | 10/2009 | Sato et al. | |
| 2009/0252191 | A1 | 10/2009 | Kubota et al. | |
| 2009/0309110 | A1 | 12/2009 | Raring et al. | |
| 2009/0315965 | A1 | 12/2009 | Yamagata et al. | |
| 2010/0001300 | A1 | 1/2010 | Raring et al. | |
| 2010/0006873 | A1 | 1/2010 | Raring et al. | |
| 2010/0025656 | A1 | 2/2010 | Raring et al. | |
| 2010/0060130 | A1 | 3/2010 | Li | |
| 2010/0164403 | A1* | 7/2010 | Liu | 315/297 |
| 2010/0207534 | A1 | 8/2010 | Dowling et al. | |
| 2010/0320499 | A1 | 12/2010 | Catalano et al. | |
| 2011/0032708 | A1 | 2/2011 | Johnston et al. | |
| 2011/0038154 | A1 | 2/2011 | Chakravarty et al. | |
| 2011/0068700 | A1* | 3/2011 | Fan | 315/185 R |
| 2011/0069490 | A1 | 3/2011 | Liu | |
| 2011/0103064 | A1 | 5/2011 | Coe-Sullivan et al. | |
| 2011/0108865 | A1 | 5/2011 | Aldaz et al. | |
| 2011/0140150 | A1 | 6/2011 | Shum | |
| 2011/0182056 | A1 | 7/2011 | Trottier et al. | |
| 2011/0182065 | A1 | 7/2011 | Negley et al. | |
| 2011/0186874 | A1 | 8/2011 | Shum | |
| 2011/0198979 | A1 | 8/2011 | Shum et al. | |
| 2011/0204763 | A1 | 8/2011 | Shum et al. | |
| 2011/0204779 | A1 | 8/2011 | Shum et al. | |
| 2011/0204780 | A1 | 8/2011 | Shum et al. | |
| 2011/0215348 | A1 | 9/2011 | Trottier et al. | |
| 2011/0291548 | A1 | 12/2011 | Nguyen The et al. | |
| 2011/0317397 | A1 | 12/2011 | Trottier et al. | |
| 2012/0043552 | A1 | 2/2012 | David et al. | |
| 2012/0235201 | A1 | 9/2012 | Shum | |
| 2012/0299492 | A1* | 11/2012 | Egawa et al. | 315/192 |
| 2012/0313541 | A1* | 12/2012 | Egawa et al. | 315/201 |
| 2013/0043799 | A1* | 2/2013 | Siu et al. | 315/193 |

OTHER PUBLICATIONS

USPTO Office Action for U.S. Appl. No. 13/025,833 dated Jul. 12, 2012.

USPTO Office Action for U.S. Appl. No. 13/211,145 dated Oct. 17, 2012.

USPTO Office Action for U.S. Appl. No. 13/482,956 dated Feb. 14, 2013.

Iso et al., 'High Brightness Blue InGaN/GaN Light Emitting Diode on Nonpolar m-Plane Bulk GaN Substrate,' Japanese Journal of Applied Physics, 2007, vol. 46, No. 40, pp. L960-L962.

International Search Report of PCT Application No. PCT/US2011/048499, dated Feb. 14, 2012, 2 pages total.

Sato et al., 'Optical Properties of Yellow Light-Emitting Diodes Grown on Semipolar (1122) Bulk GaN Substrate,' Applied Physics LetterS, vol. 92, No. 22, 2008, pp. 221110-1-221110-3.

USPTO Office Action for U.S. Appl. No. 12/481,543 dated Jun. 27, 2011.

USPTO Office Action for U.S. Appl. No. 12/491,176 dated Mar. 1, 2012.

USPTO Office Action for U.S. Appl. No. 12/879,784 dated Jan. 25, 2012.

USPTO Notice of Allowance for U.S. Appl. No. 12/879,784 dated Apr. 3, 2012.

USPTO Office Action for U.S. Appl. No. 12/880,889 dated Feb. 27, 2012.

USPTO Office Action for U.S. Appl. No. 12/914,789 dated Oct. 12, 2011.

USPTO Office Action for U.S. Appl. No. 12/914,789 dated Feb. 24, 2012.

USPTO Notice of Allowance for U.S. Appl. No. 12/914,789 dated May 17, 2012.

USPTO Office Action for U.S. Appl. No. 13/019,897 dated Mar. 30, 2012.

USPTO Office Action for U.S. Appl. No. 12/491,176 dated Jul. 19, 2012.

USPTO Office Action for U.S. Appl. No. 13/482,956 dated Aug. 17, 2012.

* cited by examiner

200

400

1100

1200

1400

1600

1800

| Input | | | | Stage 1 | | | | Stage 2 | | | | Stage 3 | | | |
|---|---|---|---|---|---|---|---|---|---|---|---|---|---|---|---|
| $V_{RMS}$ | $V_{Peak}$ | Freq | n | $I_{reg}$ | $I_{On}$ | $V_{reg}$ | $V_{On}$ | n | $I_{reg}$ | $I_{On}$ | $V_{reg}$ | $V_{On}$ | n | $I_{reg}$ | $I_{On}$ | $V_{reg}$ | $V_{On}$ |
| 120 | 170 | 60 | 14 | 368 | 50 | 57 | 46 | 25 | 206 | 368 | 94 | 101 | 36 | 143 | 206 | 130 | 135 |

| | | |
|---|---|---|
| n | | 1 |
| $V_{T\ RMS}$ | 119.7 V | |
| $I_{T\ RMS}$ | 207.7 mA | 208 mA |
| $I_{Inst\ Ave}$ | 172 mA | 172 mA |
| $P_{Inst\ Ave}$ | 19.6 W | 19.6 W |
| $P_{RMS}$ | 24.9 W | 24.9 W |
| $P_{LED\ Ave}$ | 15.4 W | 15.4 W |
| $P_{FET\ Ave}$ | 4.1 W | 4.1 W |
| PF | 0.79 | |
| EFF | 78.8 % | |

1900

2100

HIGH TEMPERATURE LED SYSTEM USING AN AC POWER SOURCE

RELATED APPLICATIONS

This application claims priority to U.S. Ser. No. 61/414,821, filed Nov. 17, 2010; and U.S. Ser. No. 61/435,915, filed Jan. 25, 2011; each of which is commonly assigned and hereby incorporated by reference.

FIELD

The present disclosure is directed to LED systems, and more particularly to power management and thermal management for high intensity LED lamps.

BACKGROUND

The present disclosure relates generally to lighting techniques. More specifically, embodiments of the disclosure are directed to circuits to drive LEDs with AC power. In one embodiment, the present disclosure provides a feedback system for automatic current compensation that stabilizes the amount of energy delivered to multiple arrays of LED devices. LED systems powered from AC power, especially those using multiple arrays of LED devices, can generate heat, and cause high operating temperatures, and thus can seize advantage from designs that include high-emissivity surfaces for heat transfer. In various embodiments, an LED lamp includes a high-emissivity surface area that emits heat through, among other ways, blackbody radiation. In various embodiments, an LED lamp includes a heat sink that is attached to the LED package, and the heat sink is characterized by a thermal emissivity of at least 0.6. The need for improved lighting techniques dates back to the 1800s.

In the late 1800's, Thomas Edison invented the light bulb. The conventional light bulb, commonly called the "Edison bulb," has been used for over one hundred years. The conventional light bulb uses a tungsten filament enclosed in a glass bulb sealed in a base, which is screwed into a socket. The socket is coupled to an AC power source or DC power source. The conventional light bulb can be commonly found in houses, buildings, outdoor lighting, and other areas requiring light. Unfortunately, more than 90% of the energy used by the conventional light bulb is dissipated as thermal energy. Additionally, the conventional light bulb eventually fails due to evaporation of the tungsten filament.

Fluorescent lighting uses an optically clear tube structure filled with a noble gas and typically also contains mercury. A pair of electrodes is coupled between the gas and an alternating power source through a ballast. Once the mercury has been excited, it discharges to emit UV light. Typically, the optically clear tube is coated with phosphors, which are excited by the UV light to provide white light. Many building structures use fluorescent lighting and, more recently, fluorescent lighting has been fitted onto a base structure, which couples into a standard socket.

Solid-state lighting techniques have also been used. Solid state lighting relies upon semiconductor materials to produce light emitting diodes, commonly called LEDs. At first, red LEDs were demonstrated and introduced into commerce. Modern red LEDs use Aluminum Indium Gallium Phosphide or AlInGaP semiconductor materials. Most recently, Shuji Nakamura pioneered the use of InGaN materials to produce LEDs emitting light in the blue color range. The blue colored LEDs led to innovations such as solid state white lighting and the blue laser diode, which in turn enabled the Blu-Ray™ (trademark of the Blu-Ray Disc Association) DVD player, and other developments. Blue, violet, or ultraviolet-emitting devices based on InGaN are used in conjunction with phosphors to provide white LEDs. Other colored LEDs have also been proposed.

One of the challenges for LED systems, especially those using arrays of LED devices, has been managing the heat generated by LED packages during operation. Various techniques such as using fans (with a down-conversion transformer) have been proposed for solving these overheating problems. Unfortunately, many techniques have been inadequate in various ways. Therefore, improved systems and methods for LED thermal management are desirable.

BRIEF SUMMARY

According to the present disclosure, techniques generally related to lighting are provided. More specifically, embodiments of the disclosure are directed to LED lamps that use circuits to drive LEDs with AC power. Exemplary embodiments are directed to LED lighting systems that include high emissivity surfaces for transfer of heat generated by the LED devices and by the circuits used to drive the LEDs (e.g., with AC power). An LED lamp includes a high-emissivity surface area that emits heat through, among other ways, blackbody radiation. In various embodiments, an LED lamp includes a heat sink that is attached to the LED package, and the heat sink is characterized by a thermal emissivity of at least 0.6.

According to an embodiment, the present disclosure provides an LED package which includes a submount having a front surface and a back surface. The front surface includes an inner region and an outer region, the inner region being characterized by a reflectivity of at least 80%. The apparatus also includes LED die disposed on the inner region of the submount. The LED die typically operate at 100 degrees Celsius or higher. The apparatus further includes a heat sink directly coupled to the back surface of the submount, the heat sink being characterized by a thermal emissivity of at least 0.5.

DETAILED DESCRIPTION

It is often desirable to arrange LED devices in arrays, pot the arrays into packages, and power the LED devices with an AC power source. For various applications, it is often desirable to be able to automatically compensate AC current when operating optical apparatus having multiple LEDs. Various techniques have been implemented for AC current compensation. For example, one implementation involves controlling strings of LED devices with switches. More specifically, a string of LEDs have a number of intermediate taps or electrical connections dividing the series string into sub-strings.

Overview

Figure 1:
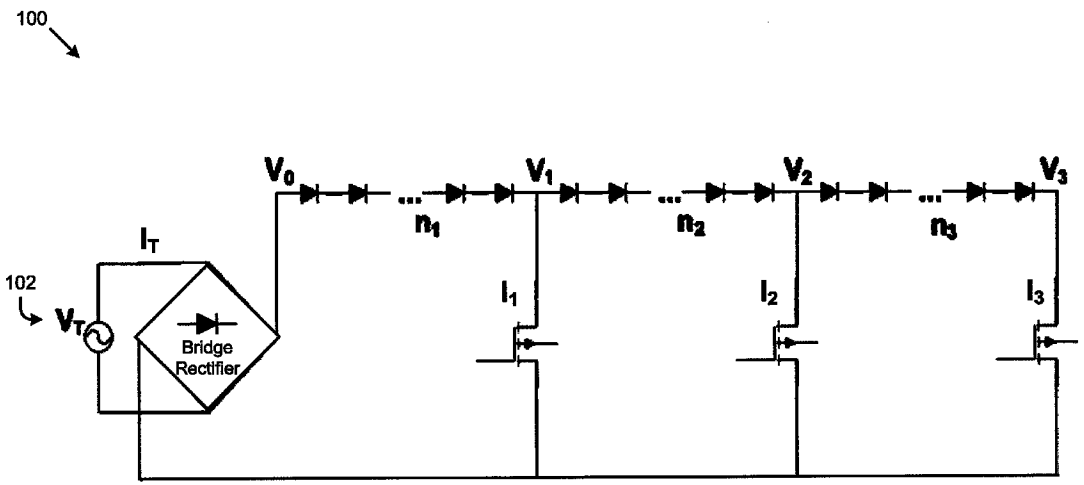
FIG. 1 is a simplified circuit schematic illustrating a LED apparatus having multiple LEDs and switches, according to some embodiments.

FIG. 1 is a simplified circuit schematic 100 illustrating a LED apparatus having multiple LEDs and switches. The LED apparatus as shown in FIG. 1 is often inefficient.

Figure 2:
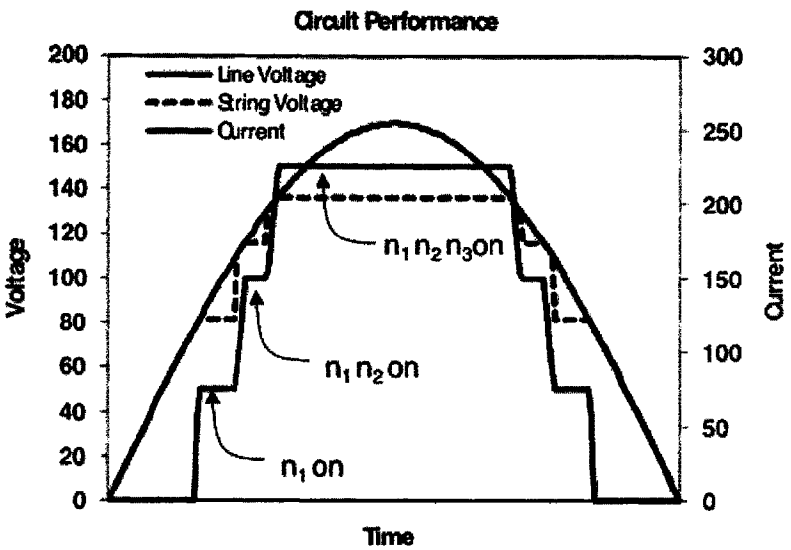
FIG. 2 is a simplified diagram illustrating the performance of the circuit illustrated in FIG. 1, according to some embodiments.

FIG. 2 is a simplified diagram 200 illustrating the performance of the circuit illustrated in FIG. 1. As shown in FIG. 1, there are 3 sub-strings of LED devices respective consisting of $n_1$, $n_2$, and $n_3$ LEDs per sub-string. As the AC line voltage (e.g., from an AC power source) increases from zero volts, first the $n_1$ string is turned on by the first transistor that regulates a current $I_1$. As the voltage further increases, the first transistor turns off while the second transistor (which regulates a current $I_2$) turns on powers both string $n_1$ and $n_2$. As the line voltage increases further, the second transistor turns off and the third transistor turns on, thus powering the entire string $n_1$, $n_2$, $n_3$ to a current $I_3$.

The power control scheme illustrated in FIG. 1 can be improved using the techniques disclosed herein. One aspect of implementations according to FIG. 1 is that the average current fluctuates with variations in line voltage or variation in the forward voltage of the LEDs. This type of current fluctuation is often undesirable. Therefore it is to be appreciated that embodiments of the present disclosure proposes a feedback control mechanism where setting of the nominal current $I_1$, $I_2$, and $I_3$ are based on monitoring of the average current.

Current Management

Figure 3:
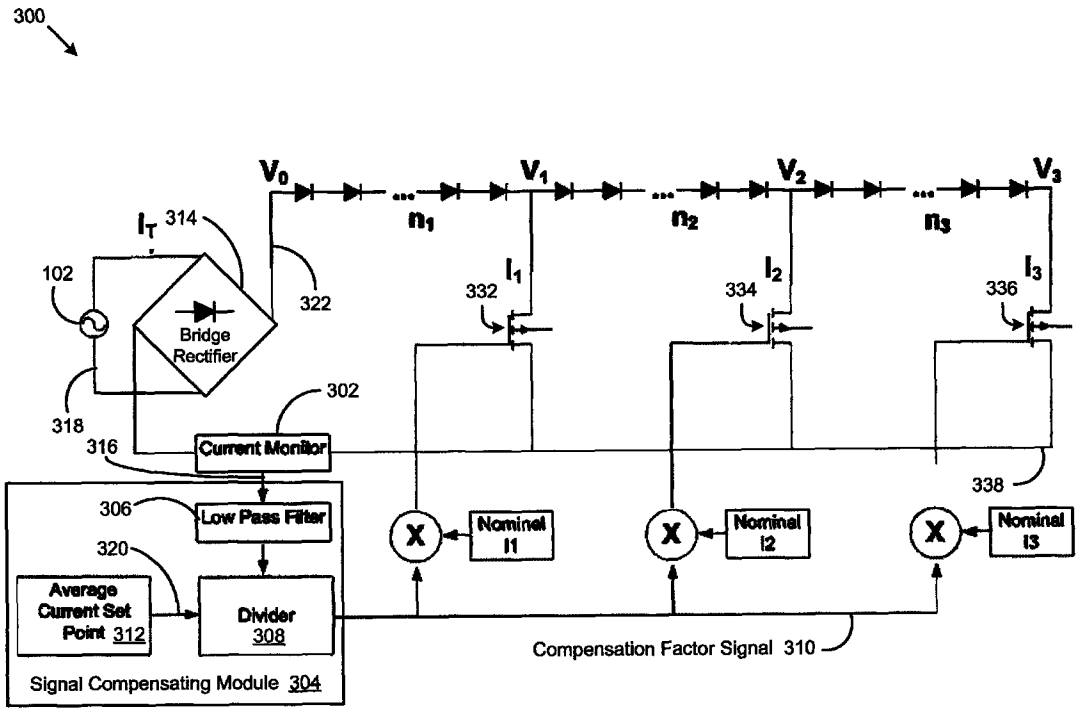
FIG. 3 is a simplified diagram illustrating an LED array system, according to some embodiments.

FIG. 3 is a simplified diagram 300 illustrating an LED array system according to an embodiment of the present disclosure. This diagram is merely an example, which should not unduly limit the scope of the claims herein. One of ordinary skill in the art would recognize other variations, modifications, and alternatives. As shown, an alternating voltage from an AC power source is rectified by a rectifier module (e.g., bridge rectifier 314) to produce a rectified output 322 with respect to a reference voltage 318. Also as shown, a current monitor module 302 is provided and drawn-current-level signal 316 between the current monitor module and the signal compensating module 304, which drawn current level signal 316 goes through a low pass filter 306. Among other things, one of the purposes of the low-pass filter is to average out the 60 Hz or 120 Hz natural variation of the system to produce a signal that substantially represents the average DC current. In this embodiment, a divider module 308 is provided to generate a compensation factor signal 310 based on the difference between the actual average current and the desired average set point signal (e.g., reference current level signal 320) as provided by the average current set point module 312. The purpose of the compensation factor signal 310 is to adjust the nominal current in each stage until the desired average set point is reached.

Accordingly, to adjust the nominal current in each stage until the desired average set point is reached, a first switch 332 is positioned between the first stage and the second stage, and a second switch 334 is positioned between the second stage and a third stage, and a third switch 336 is positioned between voltage V3 (as shown) and reference signal 338.

As shown in FIG. 3, the divider module 308 is used to generate an error signal (e.g., a compensation factor signal 310). Depending on the application, the compensation factor signal 310 can be generated by other means as well. For example, the function of the divider module can be replaced by a differential operational amplifier module that generates a compensating signal based on the difference between the signals. In various embodiments, the signal compensating function of the divider module can be implemented either in analog or digital circuits.

It is to be appreciated that the embodiments of the present disclosure can be implemented in various ways. In various embodiments, a feedback scheme based on operating current is provided. Among other things, the proposed feedback mechanism can be implemented to fully compensate for line voltage (or forward voltage).

Figure 4:
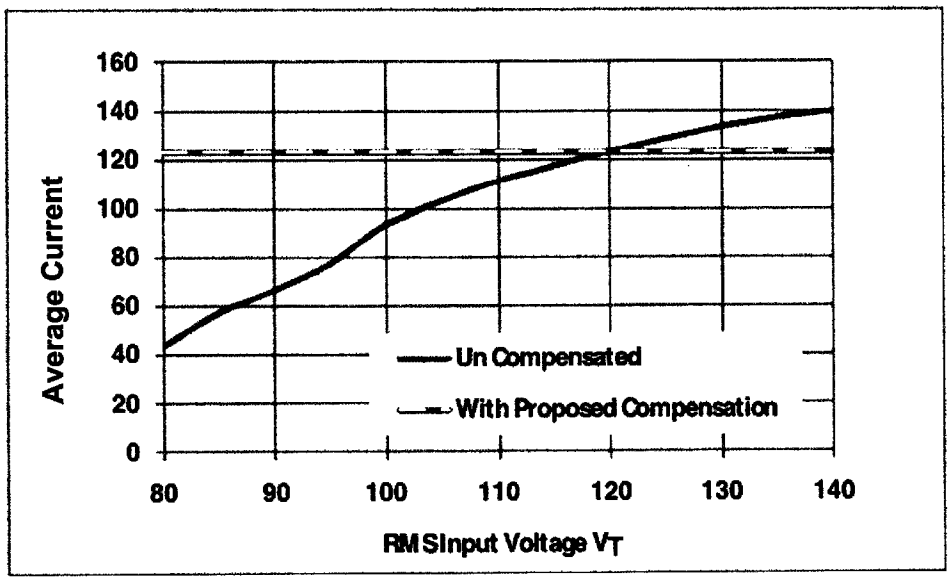
FIG. 4 is a graph illustrating average current from an LED system, according to some embodiments.

FIG. 4 is a graph 400 illustrating average current from an LED system according to an embodiment of the present disclosure. In another embodiment, the desired average current set point is programmable. It is to be appreciated that the feedback control system illustrated in FIG. 3 has a wide range of applications. In addition to reducing current fluctuation and stabilizing system performance, the system (and its variations) can be used to implement a one-time setting in the stabilizing factor to ensure that all the LED devices have the same light output. Additionally, the feedback system described above is useful in making adjustments for dimming the LED devices.

It is to be appreciated that embodiments of the present disclosure also provide a means for efficiently arranging LED devices. Now referring back to FIG. 1: In a possible configuration for utilizing an AC power supply for driving LED devices, a string of LED devices comprises a number of intermediate taps or electrical connections dividing the overall series into sub-strings. For example as shown in FIG. 1, there are 3 substrings respectively having $n_1$, $n_2$, and $n_3$ number of LED devices per sub-string. As the AC line voltage increases from zero volts, first the $n_1$ string is turned on via the first FET1 regulated to a current $I_1$. As the voltage further increases, the first FET (FET1) turns off while the second FET (FET2) turns on power for both string $n_1$ and $n_2$ to a current $I_2$. As the line voltage increases further, FET2 turns off and the third FET (FET3) turns on thus powering the entire string $n_1$, $n_2$, $n_3$ to a current $I_3$. As explained above, the configuration shown in FIG. 1 is inadequate.

Figure 5:
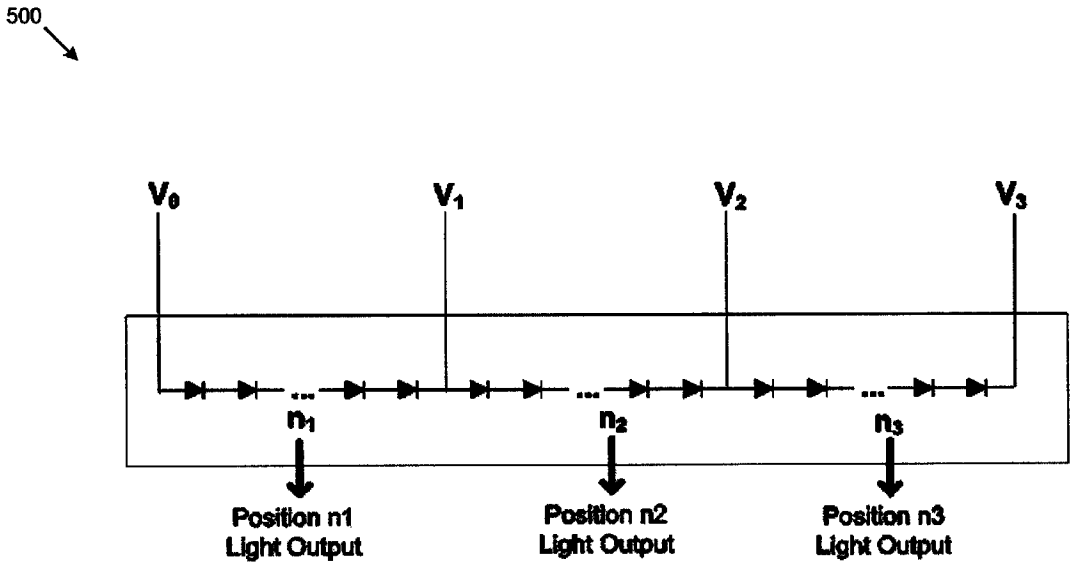
FIG. 5 is a simplified diagram illustrating uneven light output for linear light, according to some embodiments.

FIG. 5 is a simplified diagram 500 illustrating spatially uneven light output for a linear light source. As shown, the LED string $n_1$ is turned on for the longest period. Therefore, the $n_1$ is the brightest while the string $n_3$ is turned on the least amount of time thus the dimmest. As a result, for a simple implementation of a linear LED lamp as illustrated in FIG. 5, there is a problem with non-uniform light output where the position (or physical location) at the end near $n_1$ is brighter than the other end near $n_3$. It is to be appreciated that embodiments of the present disclosure provide more even light output when LED devices are arranged as a linear array.

Figure 6:
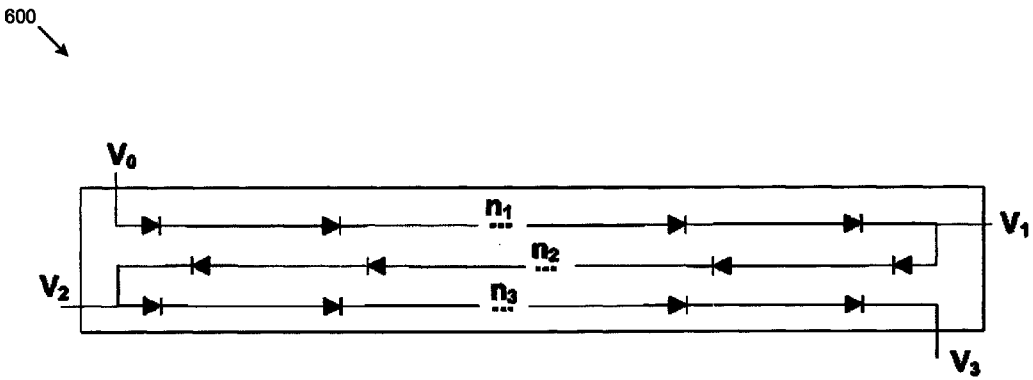
FIG. 6 is a simplified diagram illustrating an array of LED devices, according to some embodiments.

FIG. 6 is a simplified diagram illustrating an array of LED devices 600 according to an embodiment of the present disclosure. This diagram is merely an example, which should not unduly limit the scope of the claims herein. One of ordinary skill in the art would recognize other variations, modifications, and alternatives. As shown in FIG. 6, the LEDs in each string are interspersed so they substantially overlap the same lighting area. Thus in a single area or region of the linear LED lamp, light output is relatively even.

FIG. 6 depicts improvement for light output with interspersed strings. Embodiments of the present disclosure also provide even output for directional lighting. In directional lighting, a single lens is typically used to direct light out from multiple LED devices onto a location. In such cases, uneven or unbalanced light output is generated. For example, an array of LED devices 600, possibly embodied in an LED package, are positioned within an aperture on which a lens a placed. The lens translates the position of the LEDs into pattern angles. Thus if only a simple positioning of LEDs was used, there would uneven lighting gradient across the output of the lens. In various embodiments of the present disclosure, LED devices of different colors are arranged according to a predetermined pattern, which allows the combined light output from colored LED devices to be in a desired color.

Figure 7:
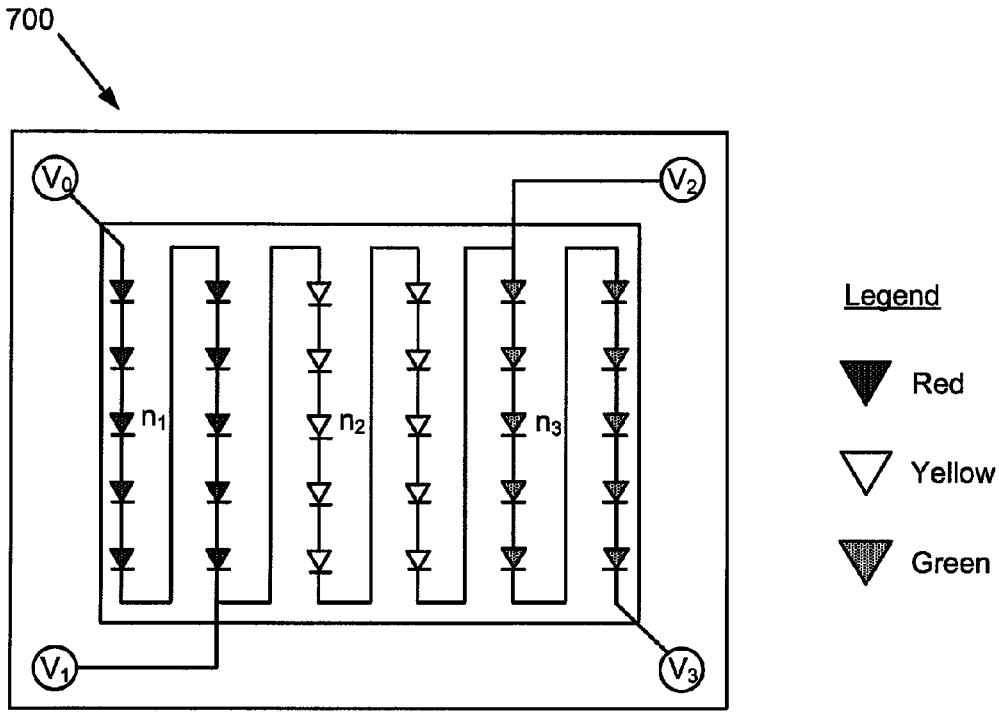
FIG. 7 is a simplified diagram illustrating an LED array with an aperture, according to some embodiments.

FIG. 7 is a simplified diagram 700 illustrating an LED array with an aperture. As shown in FIG. 7, three strings ($n_1$, $n_2$, and $n_3$) of LED devices are provided, and each string of LEDs is associated with a specific color. For example, the string $n_1$ comprises red color LEDs, the string $n_2$ comprises yellow color LEDs, and the string $n_3$ comprises green color LEDs. In operation, red light is emitted from the left side of the LED array from the string $n_1$, yellow light is emitted from the middle of the LED array from the string $n_2$, and the green light is emitted from the right side of the LED array from the string $n_3$.

Figure 8:
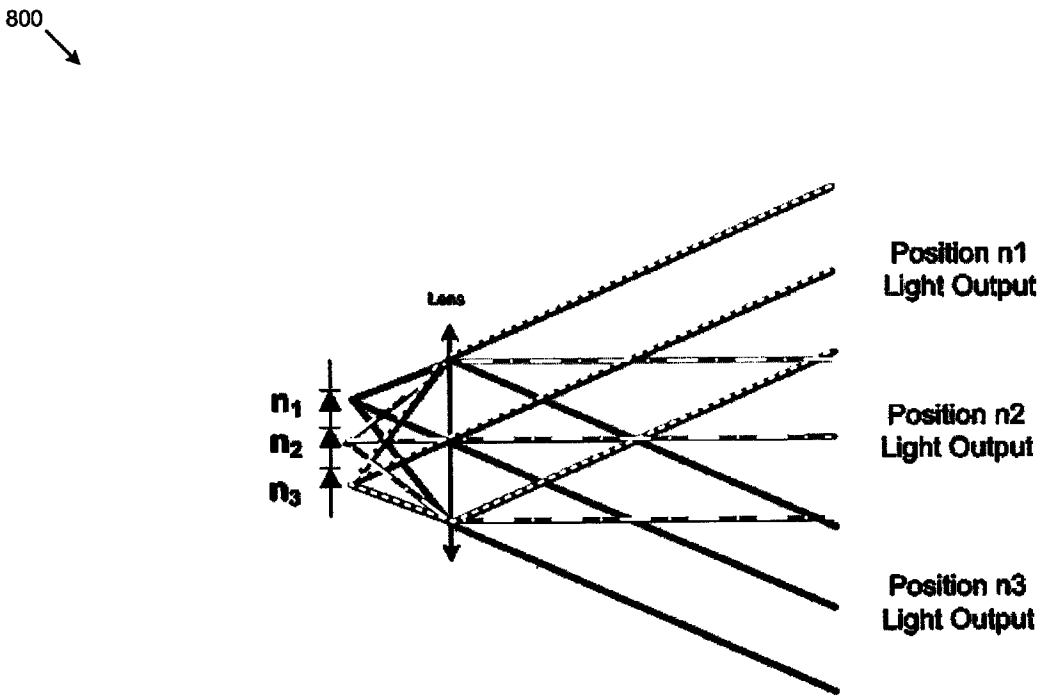
FIG. 8 is a light output diagram, according to some embodiments.

FIG. 8 is a light output diagram 800 depicting one of many embodiments where the LED array is characterized by a small size (e.g., less than 100 $cm^2$ in surface area), and the light with an uneven color distribution LED array itself does not cause a problem. However, when used in directional lighting, the light output from the LED array is projected by one or more optical members (e.g., lenses) onto a larger area. FIG. 8 is a simplified diagram illustrating an LED array having a lens. As shown in FIG. 8, light from different strings of LED devices is projected into different locations. Since each string is associated with a different color, a different color is projected onto each location.

In various embodiments, the present disclosure provides configurations for arranging LED arrays. More specifically, LED devices of different colors are evenly interspersed.

Figure 9:
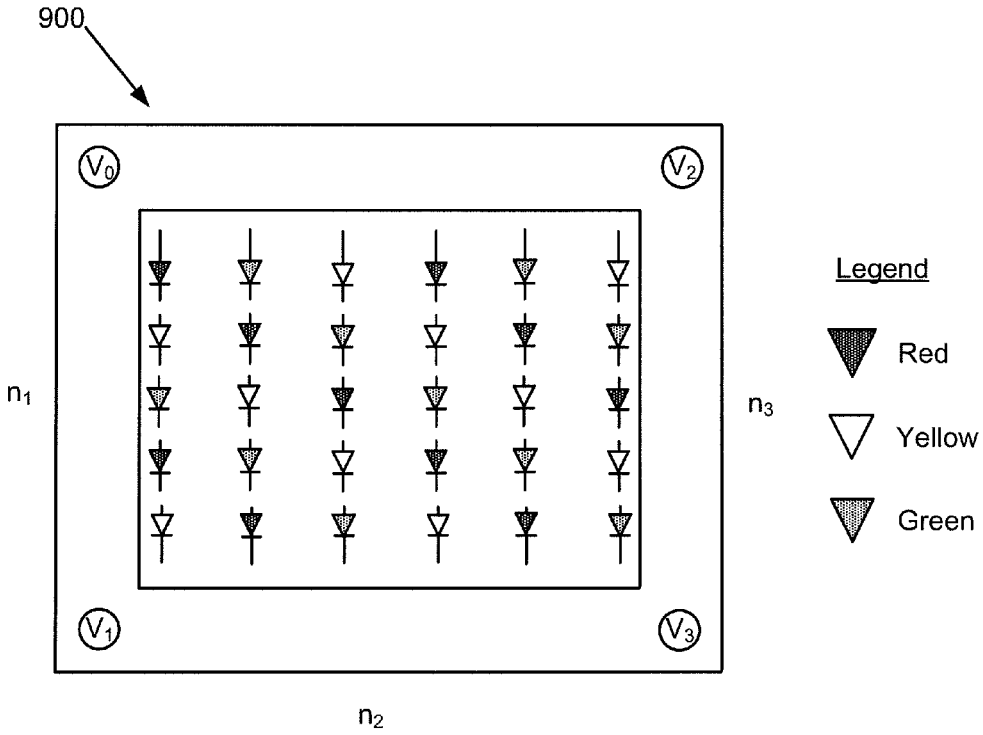
FIG. 9 is a simplified diagram where LED devices of different colors are evenly interspersed, according to some embodiments.

FIG. 9 is a simplified diagram 900 where LED devices of different colors are evenly interspersed. This diagram is merely an example, which should not unduly limit the scope of the claims. One of ordinary skill in the art would recognize many variations, alternatives, and modifications. For example, each string of LED devices (as a part of the LED array) has a mix of LED devices of different color. In an exemplary arrangement, LED devices are arranged in a pattern of red, yellow, and green. It is to be appreciated that, depending on the desired output color, many other patterns are possible.

Figure 10:
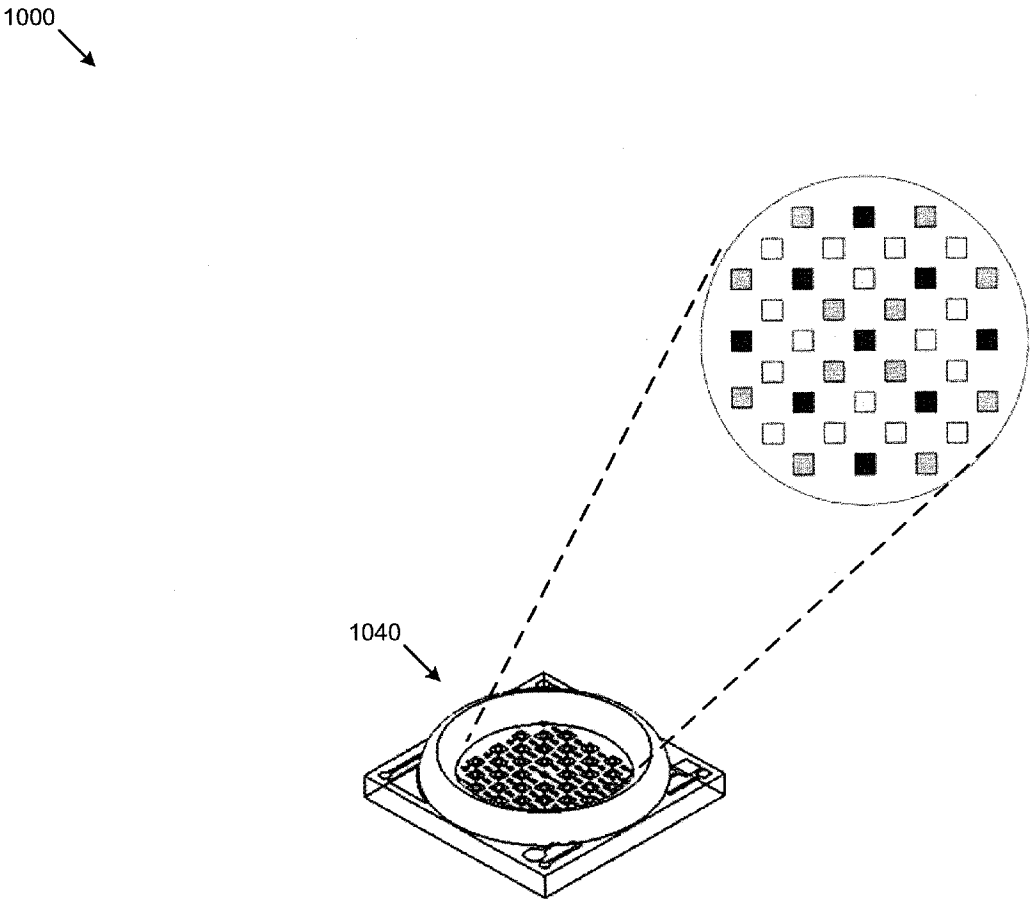
FIG. 10 is a top view of an LED package 1040 where LED devices of different colors are evenly interspersed, according to some embodiments.

FIG. 10 is a top view 1000 of an LED package 1040 where LED devices of different colors are evenly interspersed. This diagram is merely an example, which should not unduly limit the scope of the claims. One of ordinary skill in the art would recognize many variations, alternatives, and modifications. For example, the pattern of color LED devices is predetermined based on a desired color output. The LED devices shown in the arrangement of FIG. 10 can be electrically coupled to one another in various ways, such as the arrangement shown in FIG. 9.

Figure 11:
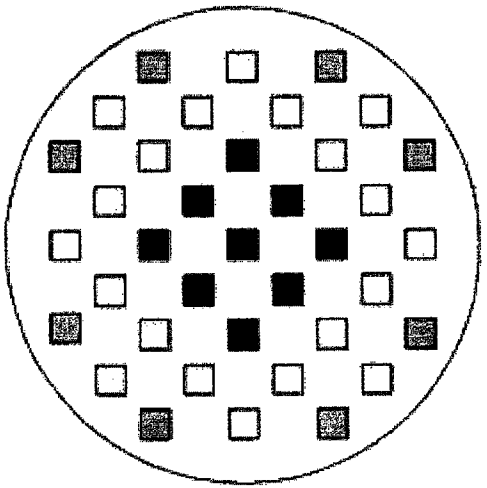
FIG. 11 is a simplified diagram illustrating a concentric pattern for arranging colored LED devices, according to some embodiments.

It is to be appreciated that other ways of arranging LED devices are possible as well. FIG. 11 is a simplified diagram 1100 illustrating a concentric pattern for arranging colored LED devices. This diagram is merely an example, which should not unduly limit the scope of the claims. One of ordinary skill in the art would recognize many variations, alternatives, and modifications.

In another implementation, the stings are arranged in substantially concentric rings around the center. Here there is still fall off due to differential turn-on times but the fall off should follow the natural concentric fall off of a directional lamp with respect to the angle. In one embodiment, the $n_1$ string, which is on the longest path, is located at the center, with string $n_2$ located in the next ring, while string $n_3$, the string that is on the shortest path, is located in the outermost area. For example, the arrangement of strings of LED devices is based on the optical properties of the optical member that projects and/or spreads the light emitted by the LED devices.

Figure 12:
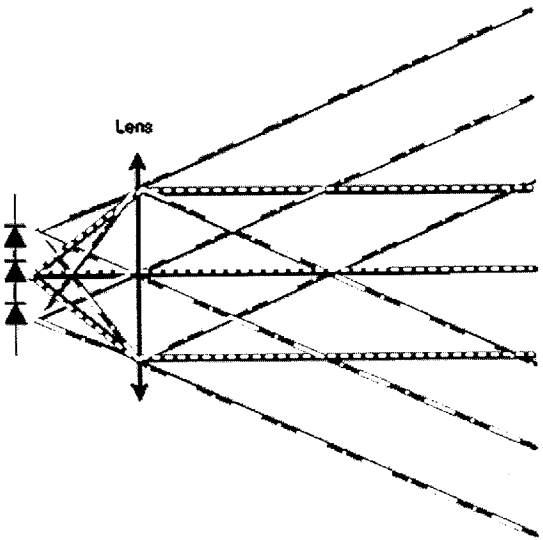
FIG. 12 is a simplified diagram illustrating a light path for LED devices arranged in concentric rings, according to some embodiments.

FIG. 12 is a simplified diagram 1200 illustrating a light path for LED devices arranged in concentric rings. This diagram is merely an example, which should not unduly limit the scope of the claims. One of ordinary skill in the art would recognize many variations, alternatives, and modifications.

It is to be understood that the arrangement and implementation of driving circuits is an important aspect for LED-based lamps. Now referring back to FIGS. 1 and 2, LED devices dividing into segments of devices are driven by a bridge circuit in a possible LED-based lamp. More specifically, a string of LEDs have a number of intermediate taps or electrical connections dividing the overall series into sub-strings. As illustrated in FIG. 1, there are three substrings comprised of $n_1$, $n_2$, and $n_3$'s number of LEDs per sub-string. As the AC line voltage increases from zero volts, first the $n_1$ string is turned on via the first FET1 regulated to a current $I_1$. As the voltage further increases, the first FET (FET1) turns off while the second FET (FET2) turns on power both string $n_1$ and $n_2$ to a current $I_2$. As the line voltage increases further, FET2 turns off and the third FET (FET3) turns on thus powering the entire string $n_1$, $n_2$, $n_3$ to a current $I_3$.

The circuit design as illustrated in FIG. 1 is developed for high voltage application such as 120 VAC. In contrast, embodiments of the present disclosure can be used in conjunction with different AC power levels, including low voltage AC applications. In particular, these techniques are applicable to LED micro-arrays. It is to be appreciated that micro-arrays are tremendously flexible in arrangement of LEDs and number of LEDs to match the drive voltage and output power requirements. A few examples are given below.

Figure 13:
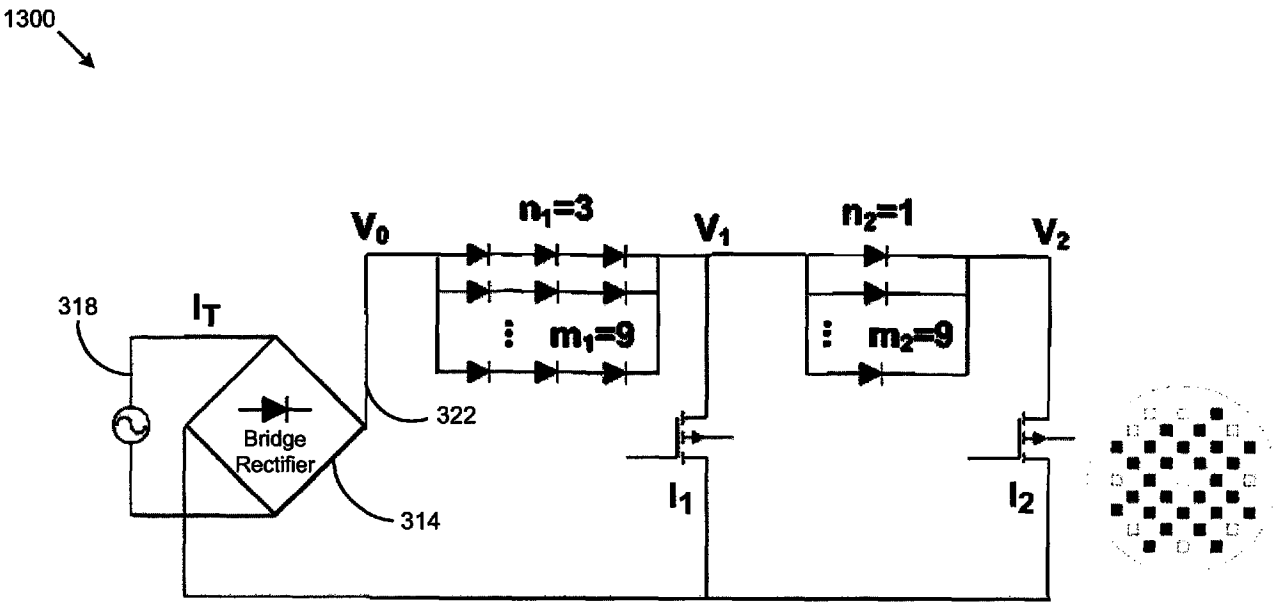
FIG. 13 is a simplified diagram illustrating an LED apparatus where LED devices are arranged in two stages, according to some embodiments.

FIG. 13 is a simplified diagram 1300 illustrating an LED apparatus where LED devices are arranged in two stages. This diagram is merely an example, which should not unduly limit the scope of the claims. One of ordinary skill in the art would recognize many variations, alternatives, and modifications. As shown, AC power is rectified by a rectifier module (e.g., bridge rectifier 314) to produce a rectified output 322 with respect to a reference voltage 318. At the first stage, 9 strings of LED devices are configured in parallel. A first switch is positioned between the first stage and the second stage, and a second switch is positioned between voltage V2 (as shown) and a reference signal. At the second stage, there are also 9 strings of LED devices. For example, each string of LED devices includes 3 LED devices, but the number can be varied depending on the specific application and the type of LED used. In an embodiment, each of the stages is associated with a specific color. For example, red colored LED devices are used in the first stage, and yellow colored LED devices are used in the second stage. From a top view, various strings of LED devices are arranged in a mixed pattern so that different colors are properly mixed.

Table 1 illustrates the voltage level at various points of the LED apparatus illustrated in FIG. 13. As illustrated in Table 1, since LED devices are electrically arranged in a parallel configuration, it is possible to power many LED devices at a low input voltage. Additionally, the parallel configuration also provides redundancy such that if one or more LED device is broken and thus creates an open circuit, only a string of LED devices is dimmed. In comparison, if all of the LED devices are arranged in series, a single broken LED device can potentially dim the entire system. Table 2 summarizes various measurements of the LED apparatus illustrated in FIG. 13.

TABLE 2

| Measurements (M) Summary | | |
|---|---|---|
| | M = | |
| | 1 | 9 |
| $V_{TRMS}$ | 12 V | |
| $I_{T_RMS}$ | 105 mA | 948 mA |
| $I_{inst_Ave}$ | 74 mA | 699 mA |
| $P_{inst_Ave}$ | 1.1 W | 10.3 W |
| $P_{RMS}$ | 1.3 W | 11.3 W |
| $P_{LED_Ave}$ | 1.1 W | 9.8 W |
| $P_{PET_Ave}$ | 0.1 W | 0.5 W |
| PF | 0.91 | |
| EFF | 95.1% | |

Figure 14:
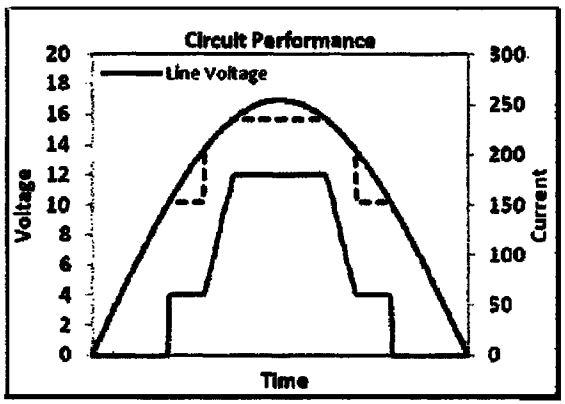
FIG. 14 is a simplified diagram illustrating the performance of the circuit illustrated in FIG. 13, according to some embodiments.

FIG. 14 is a simplified diagram 1400 illustrating the performance of the circuit illustrated in FIG. 13. This diagram is merely an example, which should not unduly limit the scope of the claims. One of ordinary skill in the art would recognize many variations, alternatives, and modifications.

Figure 15:
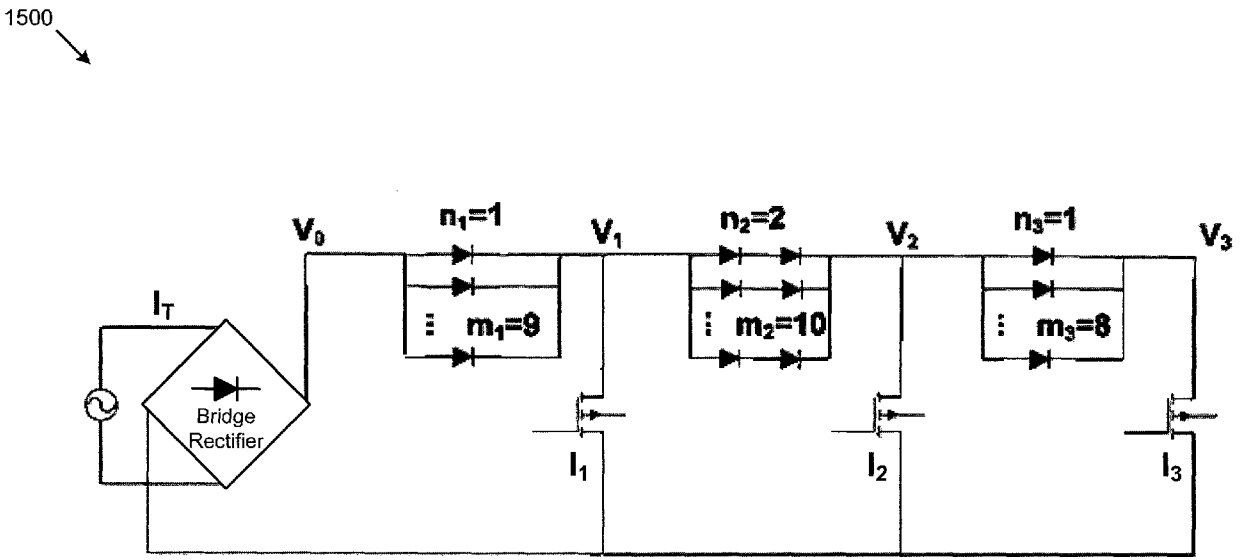
FIG. 15 is a simplified diagram illustrating an LED apparatus having LED devices arranged in three stages, according to some embodiments.

FIG. 15 is a simplified diagram 1500 illustrating an LED apparatus having LED devices arranged in three stages according to an embodiment of the present disclosure. As an example, the LED apparatus is optimized to allow dimming and reduce flickering. In various embodiments, each stage of LED devices is associated with a specific color. For example, the first stage of LED devices comprises red LEDs, the second comprises yellow LEDs, and the third comprises green LEDs.

Figure 16:
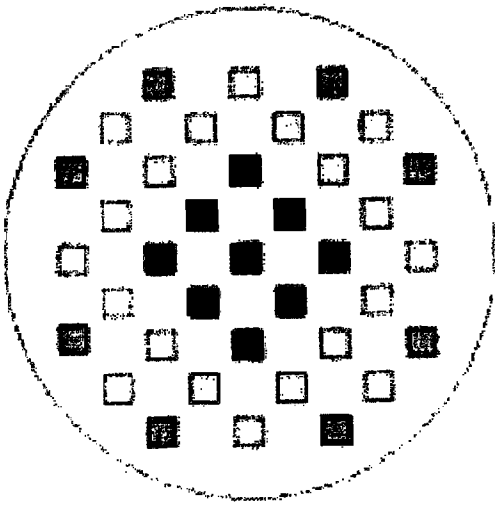
FIG. 16 is a top view of the LED apparatus having the circuit arrangement illustrated in FIG. 15, according to some embodiments.

FIG. 16 is a top view 1600 of the LED apparatus having the circuit arrangement illustrated in FIG. 15. For example, the LED devices are arranged according to a predetermined pattern.

Now referring back to FIG. 15, the circuit as shown in FIG. 15 has improved dimming and flicker characteristics due to a low number "$n_1$=1" of LED in stage 1. That is, single LEDs are arranged in parallel. This means the line voltage can be as low as the forward voltage of a single LED and the array will still turn on. Also the selection of "n=1" allows stage one to turn on earlier and potentially reduce flicker.

In various embodiments, the arrangement of parallel strings (M1, M2, M3) in each stage is not the same. More specifically, strings $m_1$, $m_0$, and $m_3$ respectively have 9, 10, and 8 LED devices in a parallel configuration. The reason for the different number is to accomplish a symmetrical layout for a circular aperture. The difference in a parallel string does not affect the average current when the FET regulators do not know the number of parallel strings. For example, a fixed current is provided regardless of the number of strings. Table 3 illustrates power measurements at various points of the LED apparatus illustrated in FIG. 15, and Table 4 illustrates power consumption and efficiency of the LED apparatus illustrated in FIG. 15.

TABLE 1

| Voltage Levels | | | | | | | | | | | | | | | | | |
|---|---|---|---|---|---|---|---|---|---|---|---|---|---|---|---|---|---|
| Input | | | Stage 1 | | | | | Stage 2 | | | | | Stage 3 | | | | |
| $V_{RMS}$ | $V_{Peak}$ | Freq | n | $I_{reg}$ | $I_{On}$ | $V_{reg}$ | $V_{On}$ | n | $I_{reg}$ | $I_{On}$ | $V_{reg}$ | $V_{On}$ | n | $I_{reg}$ | $I_{On}$ | $V_{reg}$ | $V_{On}$ |
| 12 | 17 | 60 | 3 | 60 | 50 | 10 | 10 | 4 | 180 | 60 | 16 | 14 | 4 | 180 | 180 | 16 | 16 |

TABLE 3

| Input | | | Stage 1 | | | | | Stage 2 | | | | | Stage 3 | | | | |
|---|---|---|---|---|---|---|---|---|---|---|---|---|---|---|---|---|---|
| $V_{RMS}$ | $V_{Peak}$ | Freq | n | $I_{reg}$ | $I_{On}$ | $V_{reg}$ | $V_{On}$ | n | $I_{reg}$ | $I_{On}$ | $V_{reg}$ | $V_{On}$ | n | $I_{reg}$ | $I_{On}$ | $V_{reg}$ | $V_{On}$ |
| 12 | 17 | 60 | 1 | 45 | 50 | 3 | 3 | 3 | 85 | 45 | 11 | 10 | 4 | 165 | 85 | 16 | 14 |

TABLE 4

| Summary | | |
|---|---|---|
| | M = | |
| | 1 | 9 |
| $V_{TRMS}$ | 12 V | |
| $I_{T_RMS}$ | 105 mA | 945 mA |
| $I_{inst_Ave}$ | 88 mA | 790 mA |
| $P_{inst_Ave}$ | 1.2 W | 11.3 W |
| $P_{RMS}$ | 1.3 W | 11.3 W |
| $P_{LED_Ave}$ | 1.1 W | 10.0 W |
| $P_{PET_Ave}$ | 0.1 W | 1.0 W |
| PF | 0.98 | |
| EFF | 90.7% | |

Figure 17:
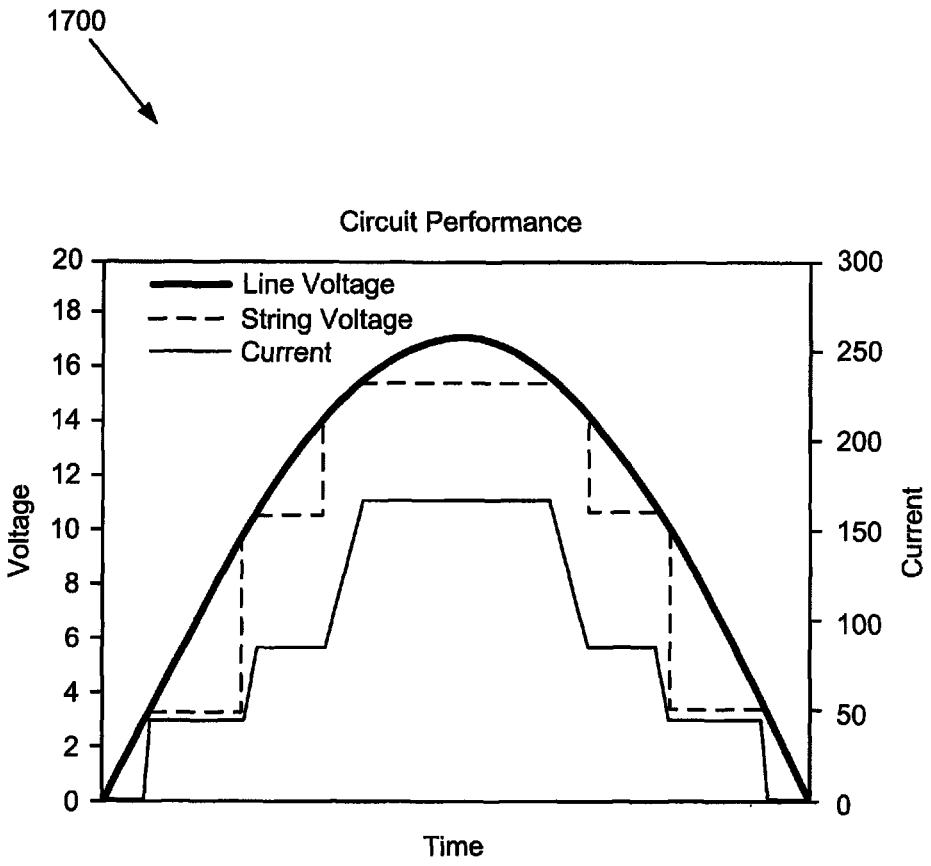
FIG. 17 is a simplified diagram illustrating the performance of the circuit illustrated in FIG. 15, according to some embodiments.

FIG. 17 is a simplified diagram 1700 illustrating the performance of the circuit illustrated in FIG. 15. It is to be appreciated that other variations are possible for staged LED string configurations. Other components, such as the current compensation module described above can be combined with the parallel LED string configuration.

As mentioned above, the staged parallel configuration can provide numerous advantages. More specifically, relatively low AC voltage can be used to power a large number of LED devices. The LED apparatus illustrated in FIGS. 15 and 16 can help reduce flickering. In various embodiments, the LED devices are specifically arranged in staged parallel configurations for reducing flickering of LED devices.

Now referring back to FIGS. 1 and 2 and the description above, such configurations for LED devices are inadequate in certain applications. In certain such applications, a string of LEDs has a number of intermediate taps or electrical connections dividing the series string into sub-strings. As illustrated in FIG. 1, there are 3 substrings composed of $n_1$, $n_2$, and $n_3$ LEDs per sub-string. As the AC line voltage increases from zero volts, first the $n_1$ string is turned on via the first FET1 regulated to a current $I_1$. As the voltage further increases, the first FET1 turns off while the second FET2 turns on power to both strings $n_1$ and $n_2$ to a current $I_2$. As the line voltage increases further, FET2 turns off and the third FET3 turns on thus powering string $n_1$, $n_2$, $n_3$ to a current $I_3$.

As an example, a possible LED package, as shown in FIG. 1, operating according to the discussed drive condition needs to set the current regulation to follow closely to sinusoid thus optimizing the power factor. For example, the LED package shown in FIG. 1 can have a power factor (PF) of 0.96. The light output flickers on/off at twice the rate of the line frequency. For example, the actual light output is the current multiplied by the # of LEDs. This makes the light output even more modulated than looking at the current alone as there are a higher number of LEDs in the later stages accompanied by high current.

In various embodiments, the present disclosure provides an LED circuit that is configured to invert the current by driving the initial stages harder than the final stages, which can help even out the light output. One possible formula for setting the current in each stage would be $$I(\text{stage } n)=I(\text{Final Stage})\times(\text{total \# of LEDs in series})/(\text{number of LEDs in stage } n)$$

This serves to set the current over the number of LEDs to be substantially equilibrated. An example of this implementation is shown below in FIG. 18.

Figure 18:
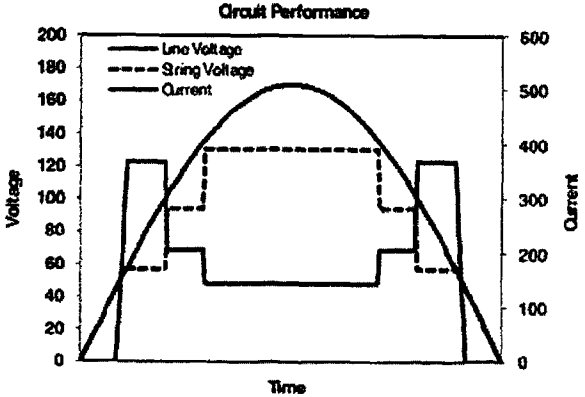
FIG. 18 depicts time charts, according to some embodiments.
Figure 19:
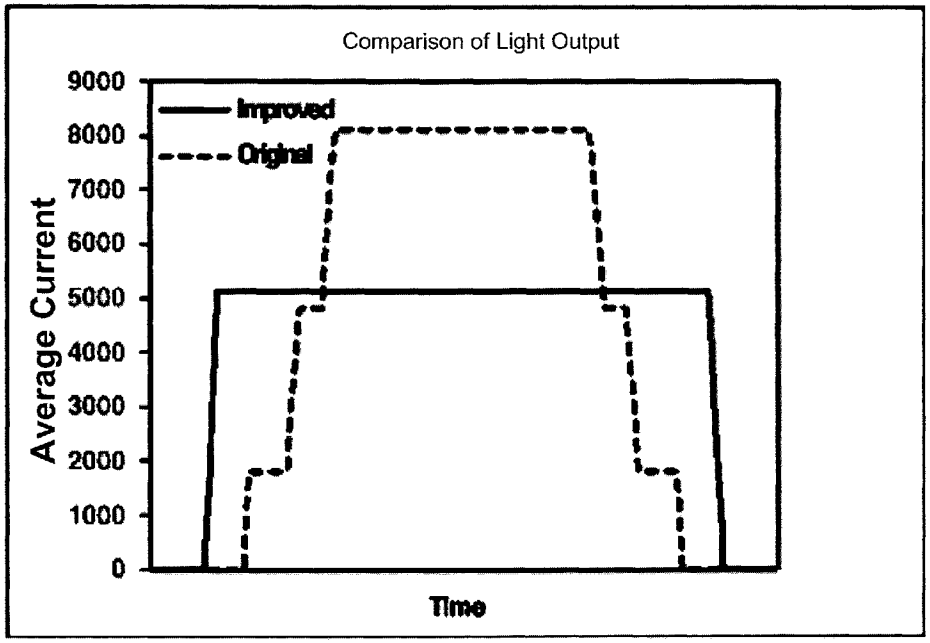
FIG. 19 depicts a light output comparison chart, according to some embodiments.

FIG. 18 depicts time charts 1800, and FIG. 19 depicts a light output comparison chart 1900. As shown, the power factor is reduced in exchange for a more linear, even light output. Among other things, the reduced power factor is 0.79 which is acceptable under the current Energy Star criteria of PF>0.7. The approximate light output of the two schemes are shown in FIG. 19. The improved method has a light output that is constant during the turn-on period.

In various embodiments, an LED package has a higher current per LED device for the initial stages than for the later stages. Depending on the application, a higher current level for the initial stage can be accomplished in various ways. More specifically, the LED package according to embodiments of the present disclosure is adapted to accommodate the higher current without substantially increasing current density. For example, current density (per area) can be reduced by using relatively larger LED packages. In certain embodiments, the amount of current per LED is reduced by arranging LED devices as parallel LED strings.

Figure 20:
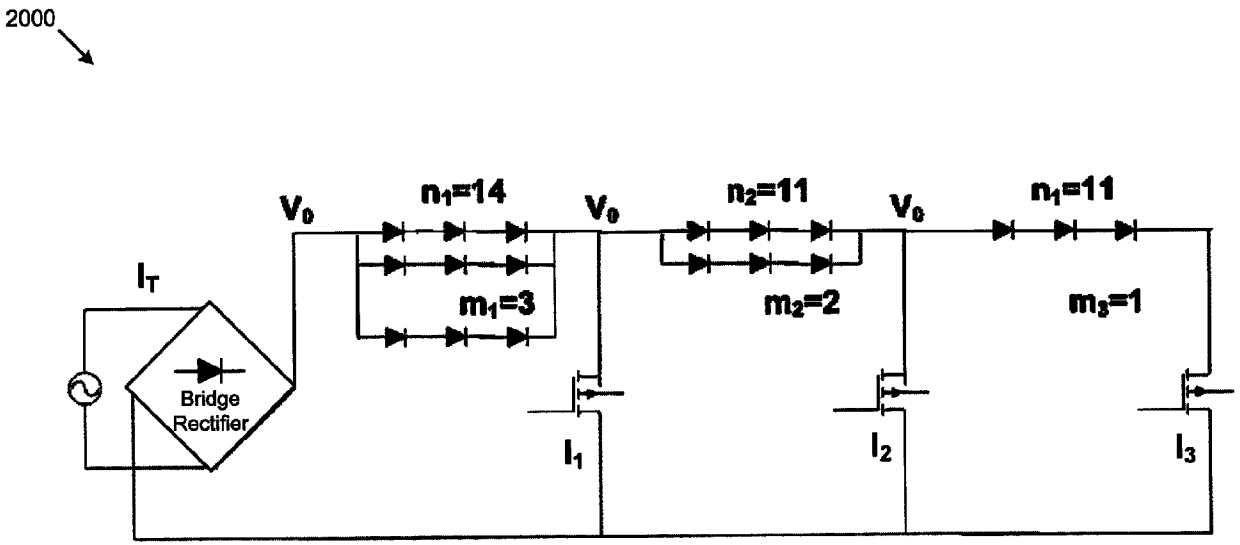
FIG. 20 is a simplified diagram illustrating an LED package with reduced current density, according to some embodiments.

FIG. 20 is a simplified diagram 2000 illustrating an LED package with reduced current density according to embodiments of the present disclosure. This diagram is merely an example and should not unduly limit scope of the claims.

As shown in FIG. 20, at the first stage $n_1$, current is divided in m=3 strings. As a result, each of the LED devices at the first stage $n_1$ only receives ⅓ of the current going into the node $V_0$. Similarly, at the second stage, LED devices also receive a reduced amount of current. Depending on the application, the number of LED strings can be varied to achieve the desired current density at each stage.

Thermal Management Using Heat Transfer

Various embodiments of the present disclosure provide an LED system that includes high emissivity surfaces for heat transfer. The LED lamp includes a high emissivity surface area that emits heat through, among other ways, black body radiation. A heat sink is attached to the LED package, and the heat sink is characterized by a thermal emissivity of at least 0.6.

As explained above, some LED lamp designs are inadequate in terms of thermal management. More particularly, certain retrofit LED lamps are limited by the heat sink volume capable of dissipating the heat generated by the LEDs under natural convection. In many applications, lamps are placed into an enclosure such as a recessed ceiling, and the running lamps can raise the ambient air temperatures to over 50 degrees Celsius. Some electronic assembly techniques and some LED lifetime issues limit the operating temperatures of the printed circuit board (PCB), which may include electronics for providing power to the LED, to about 85° C. At this temperature the emissivity of various surfaces typically plays only a small role in dissipating the heat. For example, based on the black body radiation equation and an approximately 10 $in^2$ surface area, heat sink temperature of 85° C., an ambient of 50° C., and emissivity of 0.7, the heat sink radiates about only 1.4 W.

High-intensity LED lamps may operate at a high temperature. For example, an MR-16 type of LED lamp can have an operating temperature of 150 degrees Celsius. At such junction temperatures, over 30 percent of the cooling power provided by the heat sink in an MR-16 LED lamp form factor can be provided by black body radiative cooling, while less than 70 percent is provided by ambient air convection from the ambient-air-exposed heat sink fins.

The energy transfer rate associated with the radiative cooling mechanism can be calculated from the Stefan-Boltzman equation:

$$\text{Powder Radiated}=A\epsilon\sigma(T_{hs}^4-T_a^4)$$

Where:

A is the area of the lamp that is exposed to the ambient.

$\epsilon$ is the thermal emissivity of the surface.

$\sigma$ is the Stefan-Boltzman constant.

$T_{hs}$ is the temperature in Kelvin of the heat sink surface.

$T_a$ is the temperature in Kelvin of the ambient seen by the surface of the heat sink.

In certain embodiments, various components such as electronics and LED packages are reliable and efficient at high temperatures to at least 120 degrees Celsius. However, the actual temperature at operation can be much higher, at which higher temperatures both the driver circuits and LED devices can be damaged. At such temperatures, a heat sink is often used to radiate heat and reduce the operating temperature. For example, at 120 degrees C., a heat sink may need to radiate 130% more heat than at 85 degrees C. or 3.3 W. At these temperatures, radiation plays an important role in heat dissipation, and thus high emissivity is desirable. Table 5 as shown illustrates the relationship between surface area, emissivity, temperature, and radiated power calculated from the Stefan-Boltzman equation.

TABLE 5

| A ($in^2$) | $\epsilon$ | $T_{hs}$ | $T_a$ | $P_{rad}$(W) |
|---|---|---|---|---|
| 10 | 0.7 | 85° C. | 50° C. | 1.42 |
| 10 | 0.7 | 120° C. | 50° C. | 3.32 |
| 10 | 0.9 | 120° C. | 25° C. | 4.27 |

Aluminum is one type of material for heat sinks. Its emissivity depends highly on its surface treatment. Table 6 below provides a table illustrating various emissivity levels for aluminum surfaces.

TABLE 6

| | Emissivity |
|---|---|
| Aluminum Commercial sheet | 0.09 |
| Aluminum Foil | 0.04 |
| Aluminum Commercial Sheet | 0.09 |
| Aluminum Heavily Oxidized | 0.2-0.31 |
| Aluminum Highly Polished | 0.039-0.057 |
| Aluminum Anodized | 0.77 |
| Aluminum Rough | 0.07 |

Often, LED lamps heat sinks are not optimized to maximize emissivity. For example, heat sinks for LED lamps often have polished surfaces, and often heat sink surfaces are untreated and characterized by thermal emissivity that can be significantly less than 0.5.

In various embodiments, LED lamps comprise thermal dissipation surfaces that have an emissivity of 0.77 or higher. For example, such surfaces comprise anodized aluminum that is characterized by an emissivity of 0.77.

Figure 21:
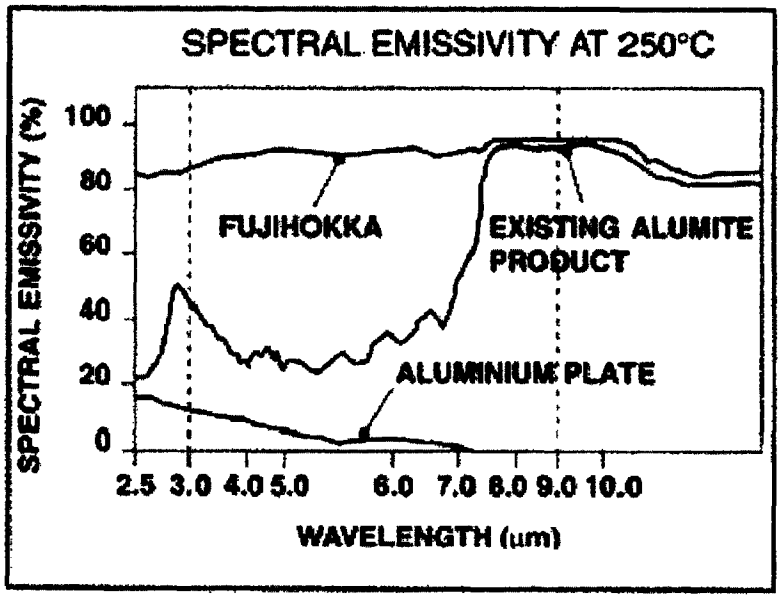
FIG. 21 is a simplified diagram illustrating emissivity level of anodized aluminum, according to some embodiments.

FIG. 21 is a diagram 2100 illustrating emissivity level of anodized aluminum (Fujihokka). In various embodiments, heat dissipating surfaces are coated with special materials to improve emissivity. For example, enhanced paint such as from ZYP Coating which includes $CR_2O_3$ or $CeO_2$, can provide an emissivity of 0.9. Alternatively coatings from Duracon can provide an emissivity of greater than 0.98. LED packages used in various lamp structures are designed to operate reliably at LED operating temperatures up to at least 150° C.

Figure 22:
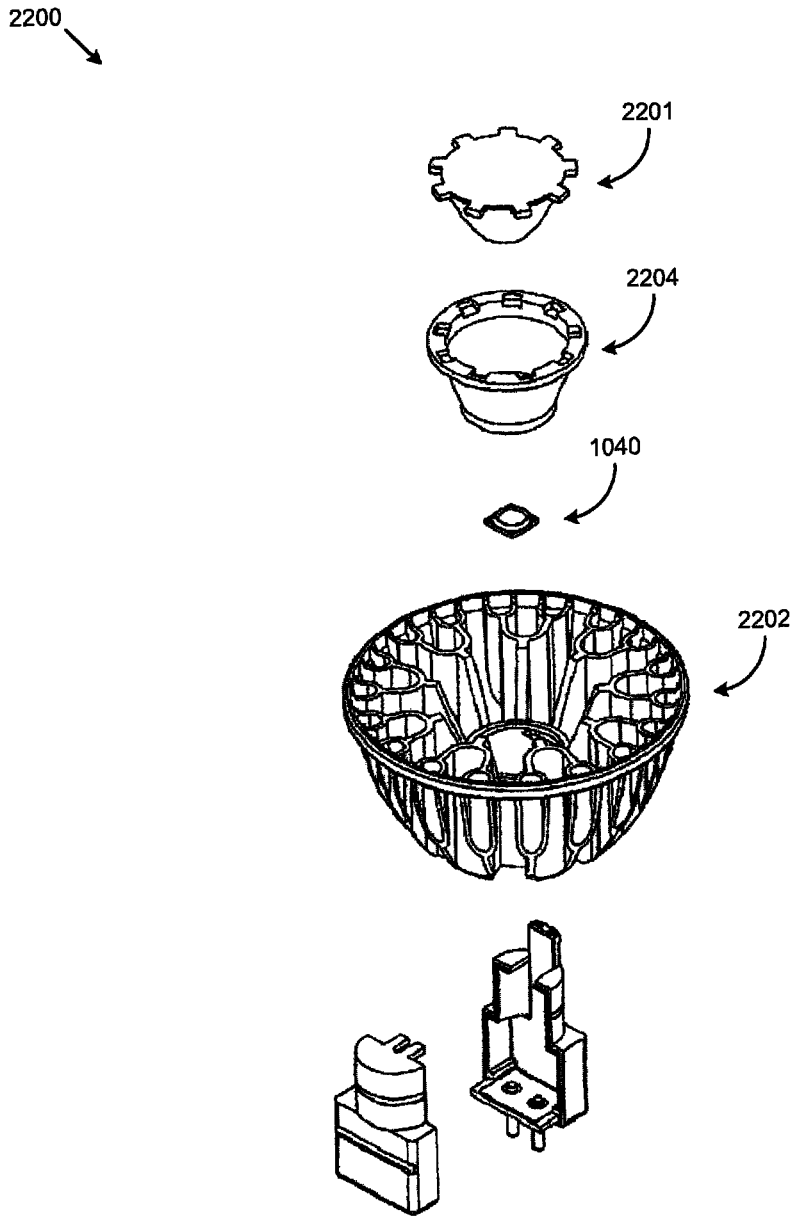
FIG. 22 is a simplified diagram illustrating an MR-16 LED lamp, according to some embodiments.

FIG. 22 is a diagram illustrating an LED lamp 2200 with an MR-16 type design. As shown, a heat sink 2202 is provided and one or more LED packages can be positioned on the surface. At high operating temperatures, over 30% of the cooling power is provided by the heat sink 2202. In an MR-16 LED lamp form factor providing blackbody radiative cooling, less than 70% of the cooling is provided by ambient air convection from the ambient-air-exposed heat sink fins. As explained above, the energy transfer rate associated with the radiative cooling mechanism can be calculated from the Stefan-Boltzman equation.

Figure 23:
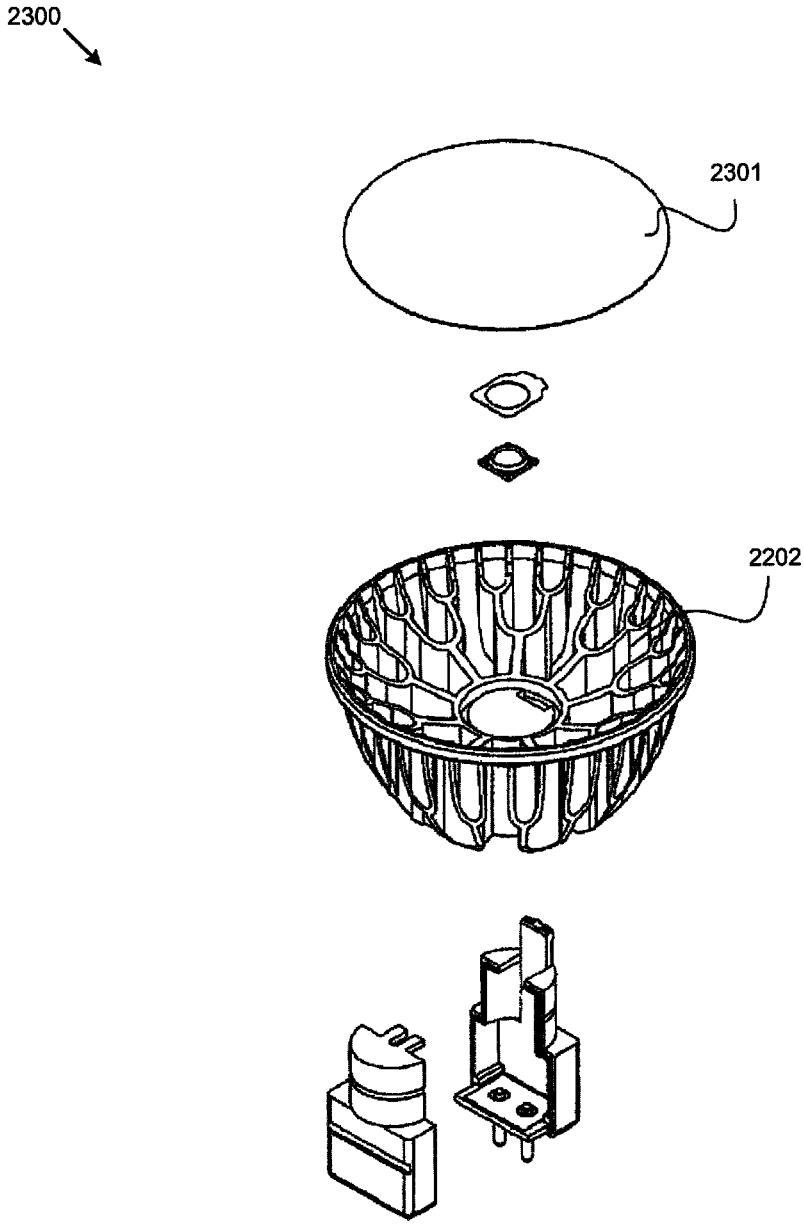
FIG. 23 is a simplified diagram illustrating an alternative LED lamp with MR-16 type of design, according to some embodiments.

FIG. 23 is a diagram illustrating an alternative LED lamp 2300 with an MR-16 type design. Similar to the LED lamp illustrated in FIG. 22, the LED lamp 2300 in FIG. 23 relies mainly on the heat sink 2202 to dissipate heat, and the surface can also be used for heat dissipation.

The importance of cooling process through radiative transfer increases rapidly as the LED operating temperature (and the resultant heat sink temperature) is increased. Altering the lamp design to optimize the effectiveness of this cooling process can contribute significantly to the overall power-handling capability of the lamp.

Various embodiments of the present disclosure provide a new LED lamp heat sink design, which maximizes cooling through radiative transfer. More specifically, LED lamp heat sink designs are useful for high-power (>3 W) LED lamps that will be placed in enclosures where the effectiveness of cooling through ambient air convection is limited. One approach is to treat or coat the exposed lamp heat sink surface to maximize its thermal emissivity, and then maximize the area of such a surface. A high-emissivity surface can be created by anodizing the surface of an aluminum heat sink or by coating the heat sink surface with a non-reflective black "paint." Ideally, the exposed lamp heat sink surface would have a thermal emissivity of at least 0.9, and, at a minimum, an emissivity of at least 0.6.

An LED lamp enclosed in a fixture where only the front surface of the lamp 2301 is exposed is an extreme, but potentially common, situation where perhaps the majority of the cooling power would be provided by radiative transfer from the front surface of the lamp. If the size of the optical lens element on such a lamp is minimized, the rest of the front surface of the lamp could be used as a high-emissivity radiative-transfer heat sink. An LED lamp can include a reflector fitted to a housing 2204.

Figure 24:
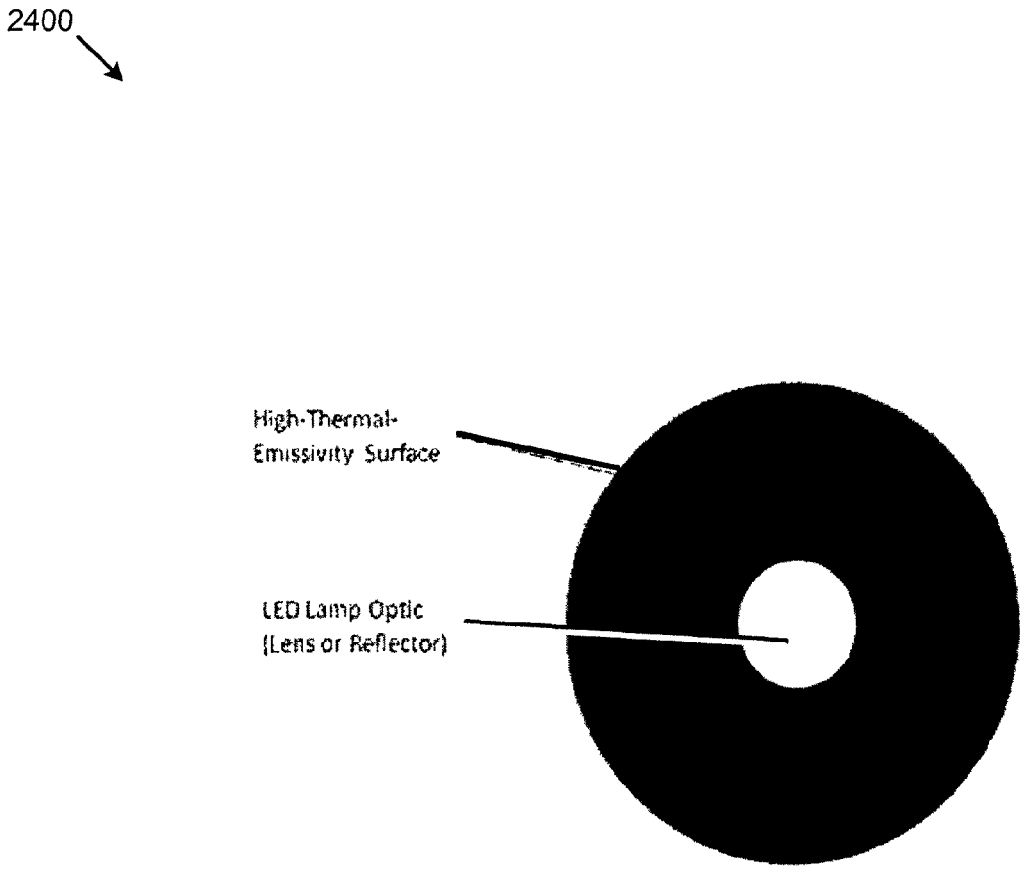
FIG. 24 is a simplified diagram illustrating a front surface of a high-radiative-transfer LED lamp according to an embodiment of the present disclosure.

FIG. 24 is a diagram illustrating a front surface 2400 of a substrate within a high-radiative-transfer LED lamp according to an embodiment of the present disclosure. As shown in FIG. 24, the front surface 2400 is in a substantially circular shape. An LED lamp and the optics thereof are positioned at the inner regions of the front surface 2400. The optic may include a lens and/or reflector. The outer region of the front surface 2400 includes a high-thermal emissivity surface. The substantially dark shade of the outer region is optimized for dissipating heat. In an embodiment, an outer region of the front surface has a high-emissivity coating (emissivity>~0.6) covering as large of a fraction as possible of the LED lamp's front surface area. As shown, the size of the optical element of the lamp (lenses, reflectors, or combinations thereof) is as small as possible for a given radiation pattern. Additionally, the thermal resistance between the LED and the front surface of the lamp are minimized as well.

Figure 25:
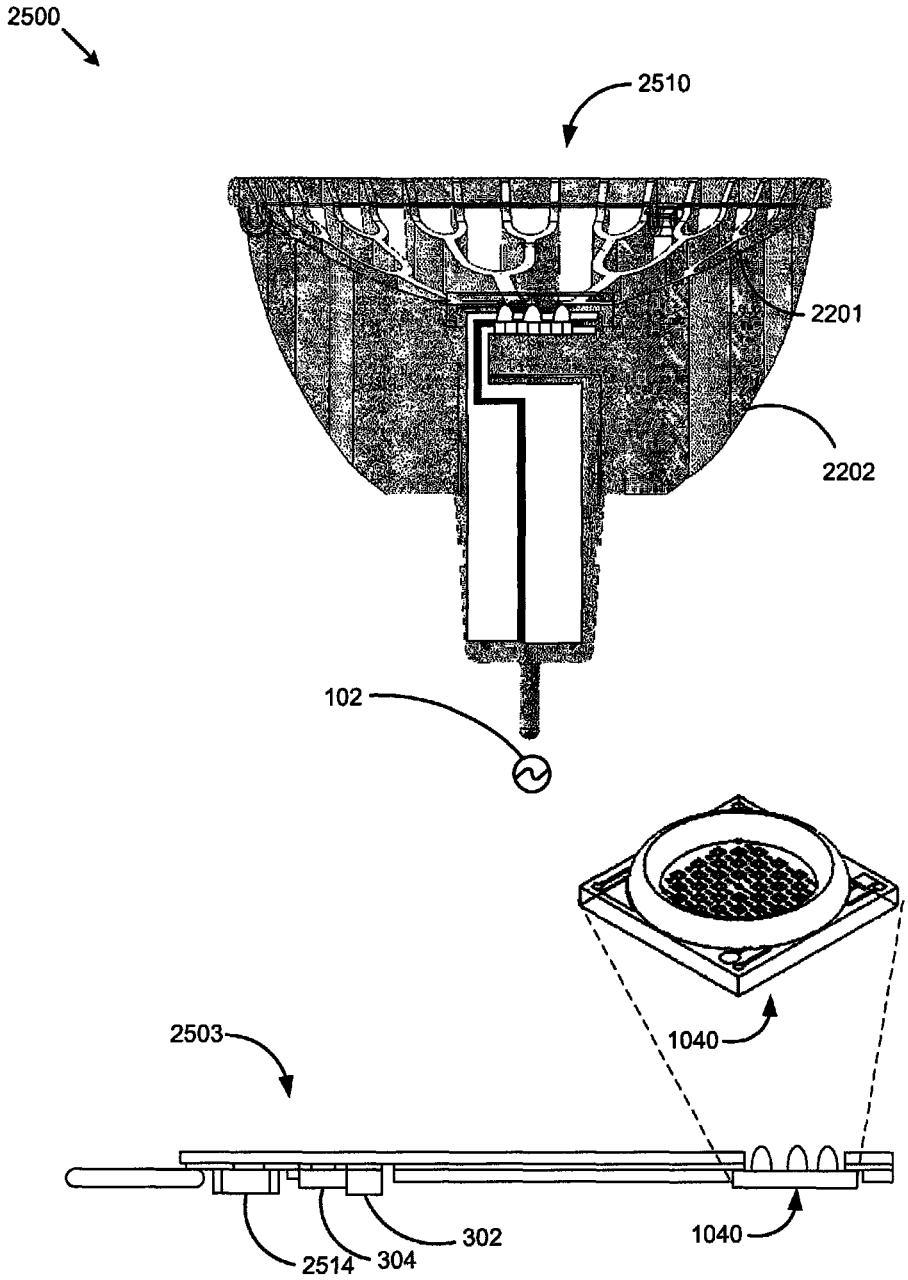
FIG. 25 is an illustration of a system comprising an LED lamp, according to some embodiments.

FIG. 25 is an illustration of an LED system 2500 comprising an LED lamp 2510, according to some embodiments. The LED system 2500 is powered by an AC power source 102 comprising a rectifier module 2514 (e.g., bridge rectifier 314) being configured to provide a rectified output to a first array of LED devices and a second array of LED devices potted into an LED package 1040. A current monitor module is electrically coupled to the first array and second array of LED devices such that the current monitor module can determine a first current level associated with the first array of LED devices and a second current level associated with the second array of LED devices; and a signal compensating module 304 electrically coupled to the current monitor module 302, the signal compensating module being configured to generate a first compensation factor signal based on a difference between the first current level and a first reference current level. As shown, the rectifier module 2514 and the signal compensating module (and other components) are mounted to a printed circuit board 2503. An LED submount 2201 has a front surface and a back surface, the front surface comprising an inner region and an outer region, and (as shown) LED die are disposed on the inner region of the submount. A heat sink 2202 has a thermal emissivity of at least 0.5.

While the above is a full description of the specific embodiments, various modifications, alternative constructions and equivalents may be used. Therefore, the above description and illustrations should not be taken as limiting the scope of the present advances which are defined by the appended claims.

What is claimed is:

1. An LED system for coupling to an AC power source comprising:

a rectifier module being electrically coupled to the AC power source, the rectifier module being configured to provide a rectified output;

a first array of LED devices, the first array of LED devices being electrically coupled to the rectifier module and to receive the rectified output;

a second array of LED devices electrically coupled to the first array of LED devices;

a current monitor module electrically coupled to the first array and second array of LED devices, the current monitor module being configured to determine a first current level using a drawn current level signal associated with the first array of LED devices and a second current level using a reference current level signal associated with the second array of LED devices; and a signal compensating module electrically coupled to the current monitor module, the signal compensating module being configured to generate a first compensation factor signal based on a difference between the first current level and a first reference current level.

2. The system of claim 1 further comprising a low pass filter electrically coupled to the current monitor module and the signal compensating module.

3. The system of claim 1 wherein the first array of LED devices is electrically coupled to the second array of LED devices in series.

4. The system of claim 1 further comprising a first switch and a second switch, the first switch being configured to control the first array of LED devices in response to the compensation factor signal.

5. The system of claim 1 wherein the signal compensating module comprises a divider module.

6. The system of claim 1 wherein the signal compensating module comprises a differential operational amplifier.

7. The system of claim 1 wherein the rectifier module is mounted to a printed circuit board.

8. The system of claim 1, further comprising:

an LED submount having a front surface and a back surface, the front surface comprising an inner region and an outer region, the inner region being characterized by a reflectivity of at least 80%, the first and second arrays of LED devices being disposed on the inner region.

9. The system of claim 8 wherein the first and second array of LED devices are configured for being operable at 100 degrees Celsius or higher.

10. The system of claim 8 further comprising:

a heat sink directly coupled to the back surface of the LED submount, the heat sink being characterized by a thermal emissivity of at least 0.5.

11. The system of claim 10 wherein the outer region of the heat sink is substantially non-reflective.

12. The system of claim 10 further comprising an MR-16 housing.

13. The system of claim 10 wherein the outer region of the heat sink is coated with anodized aluminum material and characterized by a thermal emissivity of at least 0.8.

14. The system of claim 10 wherein the heat sink is coated by a non-reflective material, a surface of the heat sink being characterized by an emissivity of at least 0.9.

15. The system of claim 10 wherein at least 10% of the front surface area is characterized an emissivity of 0.6 or greater.

16. The system of claim 10 further comprising a reflector positioned within an inner region of the front surface.

17. The system of claim 10 wherein a thermal resistance from the LED submount to the high-emissivity surface area is less than 8 C/W.

18. The system of claim 10 wherein the outer surface of the heat sink is coated by a substantially black coating.

19. An LED system for coupling to an AC power source comprising:

a rectifier module being electrically coupled to the AC power source, the rectifier module being configured to provide a rectified output;

a first array of LED devices, the first array of LED devices being electrically coupled to the rectifier module and to receive the rectified output;

a second array of LED devices electrically coupled to the first array of LED devices;

a current monitor module electrically coupled to the first array and second array of LED devices, the current monitor module being configured to determine a first current level using a drawn current level signal associated with the first array of LED devices and a second current level using a reference current level signal associated with the second array of LED devices;

a signal compensating module electrically coupled to the current monitor module, the signal compensating module being configured to generate a first compensation factor signal based on a difference between the first current level and a first reference current level; and an LED submount having a front surface and a back surface, the front surface comprising an inner region and an outer region, the inner region being characterized by a reflectivity of at least 80%.

20. An LED system for coupling to an AC power source comprising:

a rectifier module being electrically coupled to the AC power source, the rectifier module being configured to provide a rectified output;

a first array of LED devices, the first array of LED devices being electrically coupled to the rectifier module and to receive the rectified output;

a second array of LED devices electrically coupled to the first array of LED devices;

a current monitor module electrically coupled to the first array and second array of LED devices, the current monitor module being configured to determine a first current level using a drawn current level signal associated with the first array of LED devices and a second current level using a reference current level signal associated with the second array of LED devices;

a signal compensating module electrically coupled to the current monitor module, the signal compensating module being configured to generate a first compensation factor signal based on a difference between the first current level and a first reference current level;

an LED submount having a front surface and a back surface, the front surface comprising an inner region and an outer region, the inner region being characterized by a reflectivity of at least 80% the first and second arrays of LED devices being disposed on the inner region; and a heat sink coupled to at the LED submount the heat sink being characterized by a thermal emissivity of at least 0.5.

* * * * *